United States Patent [19]

Maurer

[11] Patent Number: 5,013,259

[45] Date of Patent: May 7, 1991

[54] REMOTE AUXILIARY TERMINAL ASSEMBLY

[75] Inventor: Terrence L. Maurer, Wyomissing, Pa.

[73] Assignee: Kalas Manufacturing, Inc., Denver, Pa.

[21] Appl. No.: 485,043

[22] Filed: Feb. 26, 1990

[51] Int. Cl.[5] ..... H01R 13/52

[52] U.S. Cl. ..... 439/522; 439/504

[58] Field of Search ..... 439/502, 503, 504, 505, 439/522, 754, 755, 765, 756, 764, 767, 768, 769, 770, 771, 772, 773, 774

[56] References Cited

U.S. PATENT DOCUMENTS

| | | | |
|---|---|---|---|
| 903,768 | 11/1908 | Platt | 439/551 |
| 1,014,718 | 1/1912 | Parsons . | |
| 1,840,240 | 7/1929 | Ludewig . | |
| 2,903,672 | 9/1959 | Ade . | |
| 3,456,181 | 7/1969 | Godshalk | 439/509 |
| 3,605,065 | 9/1971 | Shannon . | |
| 3,775,730 | 11/1973 | Rowls et al. | 439/755 |
| 4,049,355 | 9/1977 | Julian et al. | 439/766 |
| 4,118,097 | 10/1978 | Budnick | 439/766 |
| 4,126,367 | 11/1978 | Miller | 439/766 |
| 4,448,863 | 5/1984 | Terrell . | |
| 4,643,511 | 3/1987 | Gawlik | 439/766 |
| 4,904,205 | 2/1990 | Rice | 439/504 |

*Primary Examiner*—Larry I. Schwartz
*Assistant Examiner*—Hien D. Vu
*Attorney, Agent, or Firm*—Howson and Howson

[57] ABSTRACT

An auxiliary terminal assembly for installation on a vehicle at a readily accessible location remote from a storage battery carried in the vehicle. The terminal assembly includes an insulator which is molded around a connector element having a threaded shank that receives a grooved nut which is adapted to be gripped by jumper cable jaws. The insulator has a threaded boss which extends through a hole in a frame member on the vehicle. The grooved nut clamps to a shoulder on the connector element a cable plate that connects two cables, one of which runs to a battery terminal and the other of which runs to an electrical terminal on the vehicle.

8 Claims, 2 Drawing Sheets

REMOTE AUXILIARY TERMINAL ASSEMBLY

FIELD OF THE INVENTION

The present invention relates to storage battery connections for vehicles, and more particularly, the present invention relates to an auxiliary terminal assembly that permits battery charging and jump starting of the vehicle from a location remote from the storage battery.

BACKGROUND OF THE INVENTION

In certain types of land vehicles, such as tractors, trucks, and the like, the storage batteries are increasingly being mounted at a location that is relatively inaccessible, because the advent of low-maintenance batteries has made such a mounting location possible. Prior to maintenance-free batteries, the battery was generally carried at an accessible location because of the need for periodic checking of electrolite.

The mounting of storage batteries at less convenient locations has created certain problems. For instance, when the battery needs to be charged, or the vehicle needs to be jump-started from an auxiliary source of electrical power, it is not always easy or safe to connect the jumper cables to positive and negative terminals on the vehicle to make the requisite electrical connection. One prior art technique for solving the aforementioned problem has been to provide a remote terminal at an accessible location. The auxiliary terminal is connected to the positive terminal of a battery, and has a grooved stud to which a jumper cable can be releasably connected. The stud is secured to a frame member of the vehicle by a molded insulator which surrounds the stud intermediate its length. The stud has a threaded portion to which a permanent electrical connection is made behind the frame member. A flange on the insulator engages the outside of the frame of the vehicle, and flats are provided on the insulator to prevent it from rotating relative to the frame when the nut is tightened. A plastic cap is provided to protect the grooved stud when not in use.

While the aforementioned terminal assembly may solve the problem of providing a remote location from which to jump-start a vehicle, it has certain limitations. For instance, it is more time consuming to install than is desirable for mass production. Moreover, it does not adequately resist corrosion.

OBJECTS OF THE INVENTION

With the foregoing in mind, a primary object of the present invention is to provide a novel auxiliary terminal assembly for vehicles.

Another object of the present invention is to provide a unique remote auxiliary terminal for jump-starting, or charging, vehicle storage batteries.

Yet another object of the present invention is to provide a terminal and cable assembly which provides a remote terminal for jump-starting, or charging, a vehicle battery, and which is capable of being installed readily either when the vehicle is manufactured or as a retrofit.

A further object of the present invention is to provide for vehicle storage batteries an improved auxiliary terminal assembly which is straightforward to manufacture, which can be installed readily, and which is resistant to corrosion.

SUMMARY OF THE INVENTION

More specifically, the present invention provides an auxiliary terminal for enabling an electrical connection to be provided on a vehicle at an accessible location remote from the storage battery carried in the vehicle. To this end, a frame member having an obverse side and a reverse side is provided on the vehicle with a hole extending therethrough. A conductive connector element having a head and a threaded shank surrounded by an insulator which exposes only the threaded shank, is mounted to the frame member. The insulator has a flange which is adapted to engage the obverse side of the frame member for causing the shank to extend from the obverse side of the frame member. The insulator has a boss portion which extends through the frame member hole to the reverse side of the frame member where it is secured by a fastener which engages the boss and the reverse side of the frame member. A grooved nut is threadedly carried on the shank for enabling a permanent battery connection to be established on the obverse side of the frame member while permitting a jumper cable jaw to be releasably connected in the grooved nut. Preferably, the aforementioned assembly is shipped to the user with the battery cable clamped between the grooved nut and a shoulder on the shank so that installation can be effected simply by removing the threaded fastener, pushing the boss through the hole in the frame member, and reconnecting the fastener.

BRIEF DESCRIPTION OF THE DRAWINGS

The foregoing and other objects, features and advantages of the present invention should become apparent from the following description when taken in conjunction with the accompanying drawings, in which.

DETAILED DESCRIPTION OF THE PREFERRED EMBODIMENT

Figure 1:
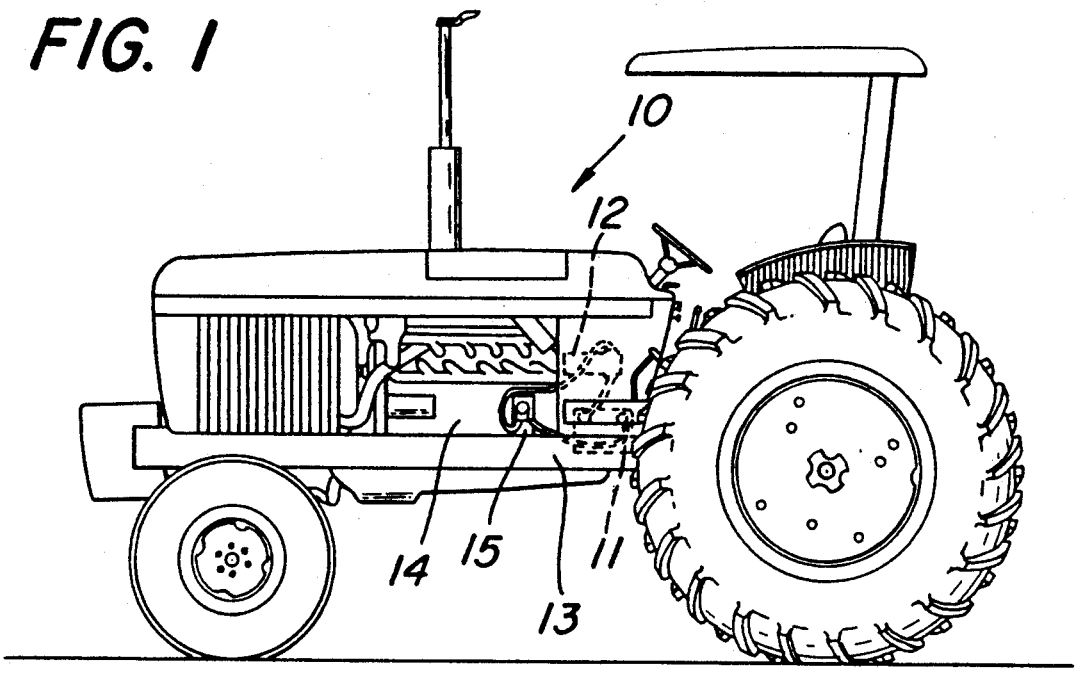
FIG. 1 is a side elevational view of a vehicle of the type with which the cable and terminal assembly of the present invention finds particularly utility.

Referring now to the drawings, FIG. 1 illustrates a vehicle 10 which has an auxiliary cable and terminal assembly embodying the present invention. In the embodiment illustrated, the vehicle 10 is a tractor having a side-mount or top-mount storage battery 11 (indicated in broken lines), mounted at a relatively inaccessible location on the vehicle. Customarily, the positive terminal of the battery is connected to the solenoid terminal on a starter motor (indicated in phantom lines at 12) and the negative terminal of the battery is preferably connected either to the starter, or a suitable ground, such as the chassis 13 of the vehicle. The illustrated location of the battery 11 makes it difficult either to charge the battery or to jump-start the vehicle 10 when the battery is dead. As noted heretofore, certain prior art attempts to provide a remote terminal for facilitating charging and jump-starting have not been entirely satisfactory.

According to the present invention, a remote auxiliary cable and terminal assembly is provided to facilitate either jump-starting vehicles having batteries mounted at relatively inaccessible locations or charging the batteries on such vehicles. To this end, the vehicle 10 is provided with a frame member which may be either formed integral with chassis 13, or may be provided by a separate metal stanchion plate such as illustrated at 15 in FIG. 1. The stanchion plate 15 is located at a conveniently-accessible location, such as alongside the engine 14 of the vehicle 10.

Figure 2:
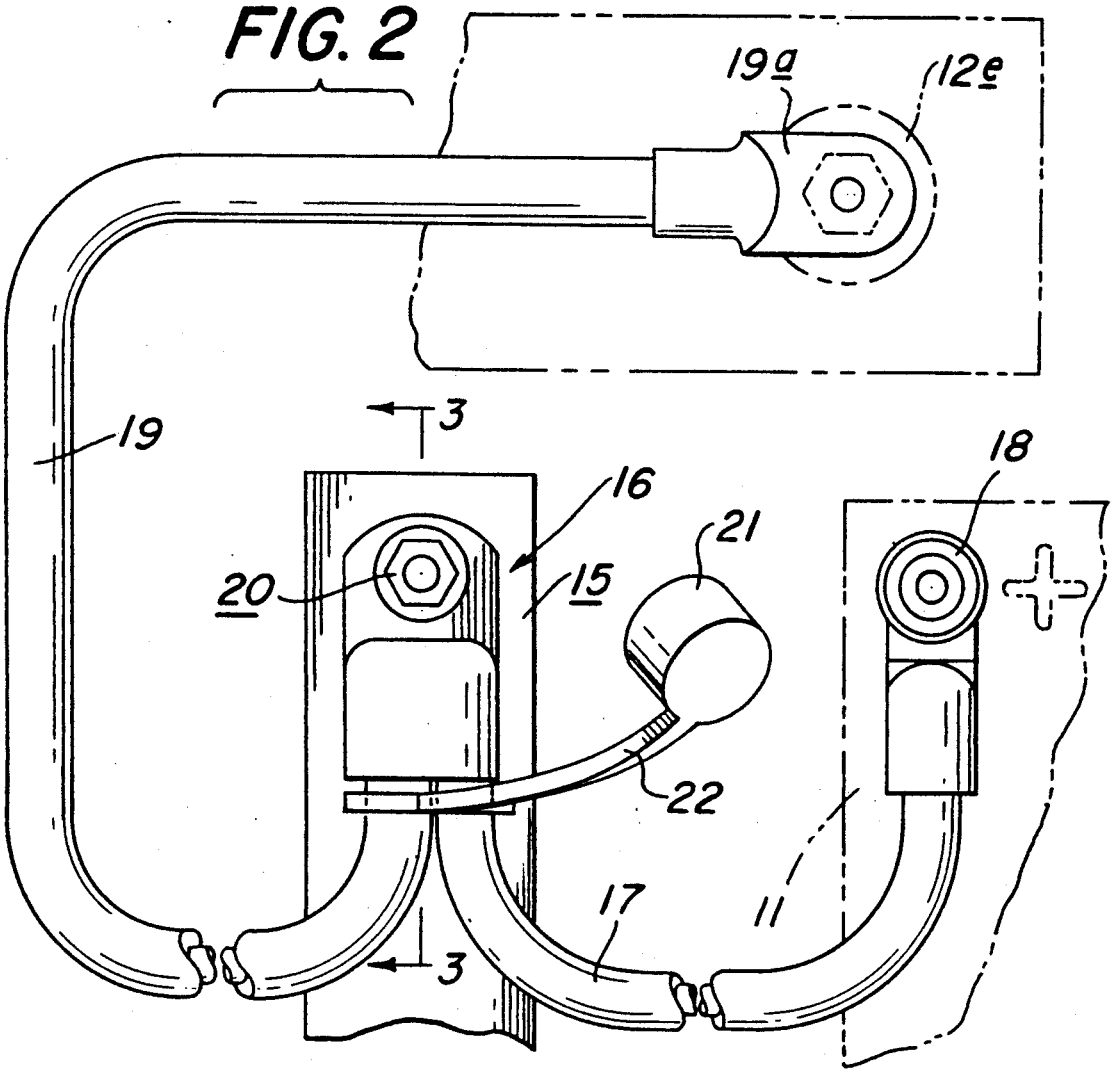
FIG. 2 is a side elevational view, partially foreshortened, of an auxiliary cable and terminal assembly shown installed on the vehicle of FIG. 1.

As best seen in FIG. 2, the stanchion plate 15 is provided for the purpose of mounting the auxiliary terminal assembly 16 of the present invention. It is connected to the positive terminal of the battery 11, as by an insulated stranded wire cable 17 and conventional side mount terminal assembly 18. The terminal assembly 16 is also connected by a insulated stranded wire cable 19 to a solenoid terminal **12*e* on the starter motor 12. Thus, electrical connection is provided from the positive battery terminal to the starter solenoid terminal 12*e* via the auxiliary terminal assembly 16 and connecting cables 17 and 19**.

As illustrated in FIG. 2, the auxiliary terminal assembly 16 includes a grooved nut 20 which is normally exposed to the obverse side 15' of the stanchion plate 15 to present a surface to be gripped by the jaws of a jumper cable (not shown). Normally, the grooved nut 20 is covered by a plastic protective cap 21 which is connected by a lanyard 22 secured to the cables 17 and 19 in the manner illustrated. As illustrated in FIG. 2, the cap 21 is removed to expose the grooved nut 20.

Figure 3:
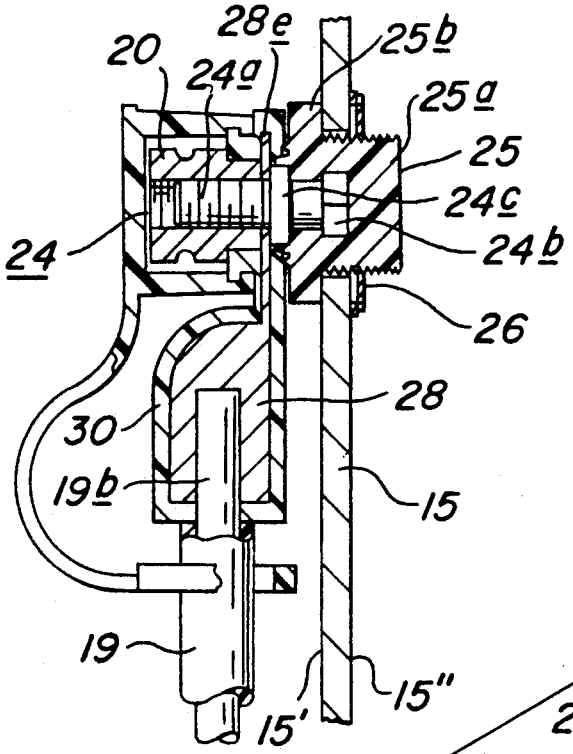
FIG. 3 is a longitudinal sectional view of the auxiliary cable and terminal assembly illustrated in FIG. 2, the sectional view being taken on line 3—3 of FIG. 2.
Figure 4:
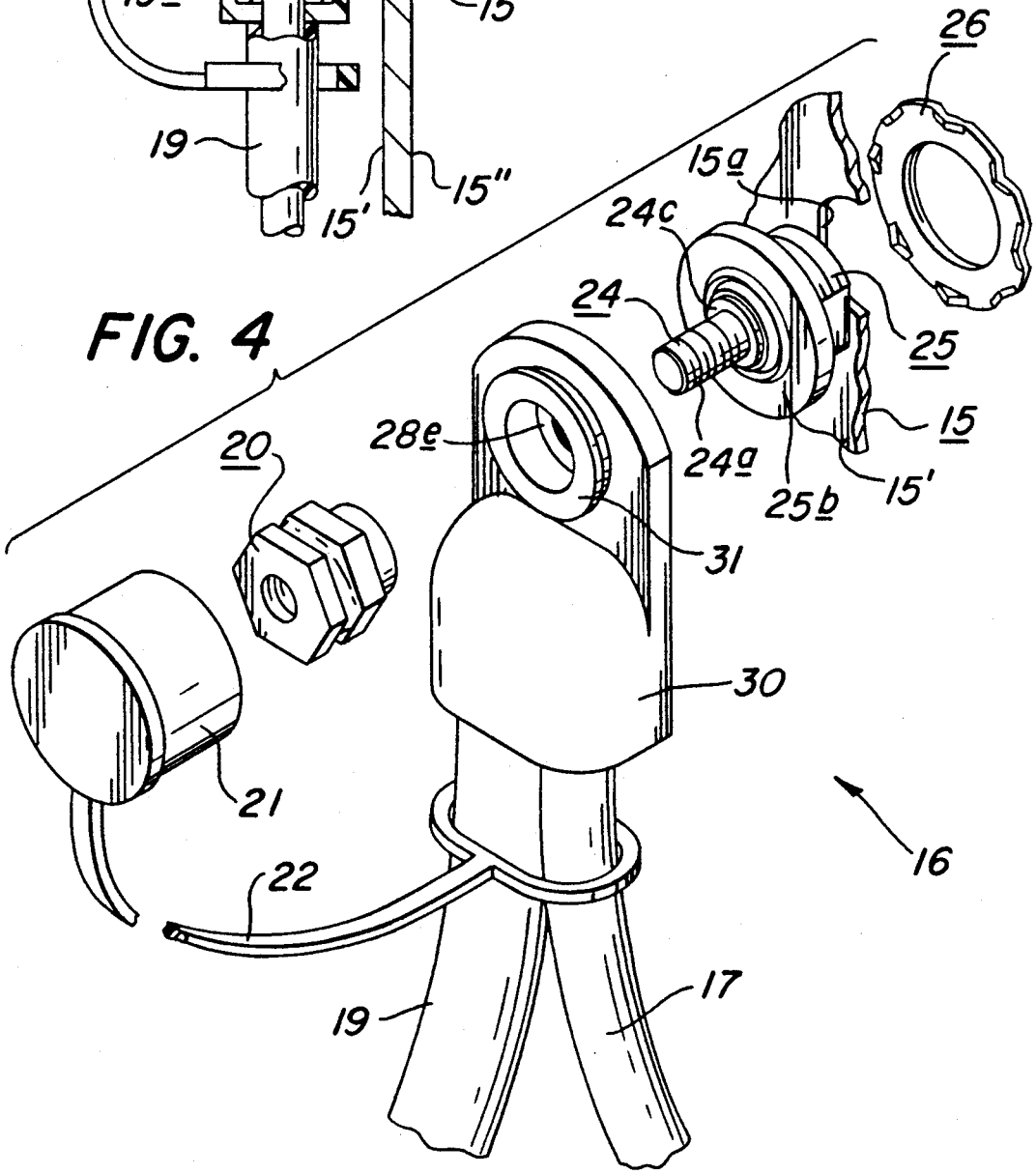
FIG. 4 is an exploded perspective view of the terminal assembly illustrated in FIG. 2.

Referring now to FIG. 4, the terminal assembly 16 includes a conductive connector element 24 which is received in an insulator 25 mounted in a hole **15*a* in the stanchion plate member 15 of the vehicle. To this end, as best seen in FIG. 3, the insulator 25 has a boss portion 25*a* which extends through the hole 15*a* in the stanchion plate 15, and a flange 25*b* which is adapted to 20 engage the obverse side 15' of the stanchion plate 15. Preferably, the boss 25*a* has a threaded periphery that is engaged by a threaded fastener 26, which, when tightened, engages the reverse side 15'' of the stanchion plate 15 to mount the insulator 25 in the position illustrated in FIG. 3**.

The connector element 24 has a threaded shank portion **24*a* which is adapted threadedly to receive the grooved nut 20. The connector element 24 also has a noncircular head 24*b* which is embedded in the body of the insulator 25 and a shoulder 24*c* located at the base of the threaded shank 24*a*. The obverse surface of the shoulder 24*c* is exposed for engaging the underside of a terminal plate 28 which is electrically connected, as by soldering, crimping, or the like, to the free ends of the cables 17 and 19, such as the free end of the cable 19*b* illustrated in FIG. 3. The grooved nut 20 clamps the flat portion 28*a* of the plate 28 against the conductive element shoulder 24*c*** to provide a desirable electrical contact.

The free ends of the cables 17 and 19 and the cable plate 28 are protected by an insulated mass 30 which is molded over them, except for the regions in the vicinity of the obverse side of the shoulder **24*c* and the grooved nut 20 which must be exposed to provide electrical contact. The molded mass 30 has an upstanding collar portion 31 shaped and adapted releasably to engage the cap 21 as illustrated in FIG. 3** to protect the clamped cable assembly from corrosion, and to protect the entire assembly from inadvertent contact when not in use actually jump-starting the vehicle or charging the battery.

The maximum benefit from the present invention is realized when the terminal assembly 16 is shipped from the factory assembled in the manner illustrated in FIG. 3, except for the presence of the stanchion plate 15 which is normally provided by the manufacturer of the vehicle. When thus shipped, all that is required either at the place of manufacture of the vehicle, or at the place of retrofit for the vehicle, is for the fastener 26 to be removed from the threaded boss **25*a* to permit the boss 25*a* to be inserted axially through the plate hole 15*a*, whereupon the threaded fastener 26 is reinstalled and tightened. The terminal 18 of the cable 17 can then be connected to the positive terminal of the battery 11, and the terminal 19*a* of the cable 19 connected to the starter solenoid terminal 12*a***. No additional installation steps are required. This makes installation straightforward and easy to accomplish with a minimum of labor.

Jump-starting is effected simply by removing the protective cap 21 to expose the grooved nut 20 for receiving the jaws of a jumper cable which are applied in the customary manner to the grooved nut 20 and the chassis 13 of the vehicle 10.

In view of the foregoing, it should be apparent that the present invention now provides an improved auxiliary terminal for vehicles. The auxiliary terminal is straightforward to manufacture and can be installed quickly. It is also resistant to corrosion.

While a preferred embodiment of the present invention has been described in detail, various modifications, alterations and changes may be made without departing from the spirit and scope of the invention as defined in the appended claims.

I claim:

1. For use in providing an electrical connection on a vehicle at an accessible location remote from a storage battery carried on the vehicle, the vehicle mounting a frame member having a hole extending between the obverse and the reverse sides of the frame member, a remote jump start terminal, comprising:

a connector element having a head and a threaded shank, an insulator molded directly onto said head for completely embedding it while exposing a portion of said threaded shank, said insulator having a flange portion adapted to engage the obverse side of the frame member for causing said shank to extend only from the obverse side of the frame member, said insulator also having a boss portion extending through said frame member hole to the reverse side of said frame member, fastener means for releasably engaging said boss portion and the reverse side of said frame member for mounting said insulator, and a grooved nut threadedly carried on said shank for effecting a permanent battery cable connection to said shank and insulator while permitting releasable connection of a jumper cable from the obverse side of the vehicle frame.

2. Apparatus according to claim 1 where said connector element has a head with a non-circular shape embedded in said insulator and a shoulder with an exposed surface located between said threaded shank and said head.

3. Apparatus according to claim 1 where said boss portion of said insulator has external threads and said fastener means threadedly engages said threads.

4. Apparatus according to claim 1 where said boss and frame hole have surface means cooperable to prevent rotation of the insulator relative to the hole in the frame.

5. Apparatus according to claim 1 including battery cable means having a cable plate with a hole receiving said connector element and clamped thereto by said grooved nut.

6. Apparatus according to claim 1 including a battery cable plate having a hole receiving said connector element, said connector element having a shoulder on said threaded shank, said grooved nut clamping said cable plate against said shoulder.

7. Apparatus according to claim 1 including a battery cable plate connected to said connector element and a pair of battery cables connected to said battery cable plate.

8. For use in providing an electrical connection on a vehicle at an accessible location remote from a storage battery carried on the vehicle, the vehicle mounting a frame member having a hole extending between the obverse and the reverse sides of the frame member, a remote jump start terminal, comprising:

a connector element having a head and a shank with a threaded portion, said head having a non-circular shape and a shoulder located between said head and said threaded portion of said shank;

an insulator molded directly onto and around said head for completely encasing it while exposing said threaded portion of said shank and said shoulder, said insulator having a flange portion adapted to engage the obverse side of the frame member for causing said shank to extend only from the obverse side of the frame member;

said insulator also having a boss portion with external threads extending through said frame member hole to the reverse side of said frame member, said boss portion having at least one flat surface interrupting said threads for cooperating with a complementary surface on said frame member to prevent rotation of said insulator relative to the frame member;

fastener means for releasably engaging said threads of said boss portion and the reverse side of said frame member for mounting said insulator; and a grooved nut threadedly carried on said shank for effecting a permanent battery cable connection to said shank and insulator while permitting releasable connection of a jumper cable from the obverse side of the vehicle frame.

* * * * *